US009640871B2

(12) United States Patent
Cho et al.

(10) Patent No.: US 9,640,871 B2
(45) Date of Patent: May 2, 2017

(54) BROADBAND VARIABLE ANTENNA DEVICE AND PORTABLE TERMINAL HAVING THE SAME

(71) Applicant: Samsung Electronics Co., Ltd, Gyeonggi-do (KR)

(72) Inventors: Bum-Jin Cho, Gyeonggi-do (KR); Gyu-Sub Kim, Gyeonggi-do (KR); Joon-Ho Byun, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 210 days.

(21) Appl. No.: 13/939,109

(22) Filed: Jul. 10, 2013

(65) Prior Publication Data

US 2014/0015723 A1 Jan. 16, 2014

(30) Foreign Application Priority Data

Jul. 10, 2012 (KR) ..... 10-2012-0074930

(51) Int. Cl.
*H01Q 9/04* (2006.01)
*H01Q 13/10* (2006.01)

(52) U.S. Cl.
CPC ..... *H01Q 13/106* (2013.01); *H01Q 13/103* (2013.01); *H01Q 9/0414* (2013.01)

(58) Field of Classification Search
CPC H01Q 1/44; H01Q 1/24; H01Q 1/241; H01Q 1/242; H01Q 1/243; H01Q 1/38;
(Continued)

(56) References Cited

U.S. PATENT DOCUMENTS 6,603,430 B1 * 8/2003 Hill et al. ..... 343/702
6,639,559 B2 * 10/2003 Okabe et al. ..... 343/700 MS
(Continued)

FOREIGN PATENT DOCUMENTS

CN 101243583 A 8/2008
CN 102300437 A 12/2011
(Continued)

OTHER PUBLICATIONS

Extended European Search Report dated Sep. 2, 2013 in European Patent Application No. 13173137.4; 6 pages.
(Continued)

*Primary Examiner* — Graham Smith
*Assistant Examiner* — Patrick Holecek

(57) ABSTRACT

Disclosed is an antenna device for a portable terminal, including a circuit board having a conductive layer attached on a surface, a first slit formed by partially removing the conductive layer in a position adjacent to one side of the circuit board, the first slit extending in parallel with a lateral periphery of the circuit board, a radiation portion comprising part of the conductive layer positioned on the lateral periphery of the circuit board in one side of the first slit, and a feed line placed on the first slit and adapted to feed the radiation portion from the other side of the first slit. The radiation portion further comprises a second slit extending from the first slit to the lateral periphery of the circuit board across part of the conductive layer forming the radiation portion, and a frequency adjustment element placed on the second slit.

20 Claims, 7 Drawing Sheets

(58) Field of Classification Search
CPC H01Q 1/48; H01Q 1/52; H01Q 1/528; H01Q 5/328; H01Q 5/50; H01Q 9/0407; H01Q 9/0414; H01Q 9/0478; H01Q 9/40; H01Q 9/42; H01Q 13/10; H01Q 13/106; H01Q 13/16
USPC ..... 343/700 MS, 702, 720
See application file for complete search history.

(56) References Cited

U.S. PATENT DOCUMENTS

| | | | | |
|---|---|---|---|---|
| 6,864,848 | B2 * | 3/2005 | Sievenpiper | 343/767 |
| 6,985,108 | B2 * | 1/2006 | Mikkola | H01Q 1/243 343/700 MS |
| 7,408,517 | B1 * | 8/2008 | Poilasne et al. | 343/742 |
| 7,623,083 | B2 * | 11/2009 | Chung | H01Q 13/10 343/700 MS |
| 7,768,462 | B2 * | 8/2010 | Zhang | H01Q 1/243 343/702 |
| 7,872,605 | B2 * | 1/2011 | Baliarda et al. | 343/700 MS |
| 7,917,104 | B2 * | 3/2011 | Manssen et al. | 455/121 |
| 8,284,116 | B2 * | 10/2012 | Hwang et al. | 343/860 |
| 9,035,833 | B2 * | 5/2015 | Zhang | H01Q 1/243 343/702 |
| 2003/0122721 | A1 | 7/2003 | Sievenpiper | |
| 2007/0040751 | A1 * | 2/2007 | Boyle | H01Q 1/242 343/702 |
| 2010/0156748 | A1 | 6/2010 | Hwang et al. | |

FOREIGN PATENT DOCUMENTS

| | | | |
|---|---|---|---|
| KR | 10-2012-0033760 | | 4/2012 |
| WO | WO 2006/097496 | A1 | 9/2006 |
| WO | WO 2006/114477 | A1 | 11/2006 |
| WO | WO 2012/044012 | A2 | 4/2012 |

OTHER PUBLICATIONS

State Intellectual Property Office of the P.R.C., "First Office Action," Application No. 201310289046.5, Dec. 30, 2016, 26 pages, publisher SIPO, Beijing Shi, China.

* cited by examiner

BROADBAND VARIABLE ANTENNA DEVICE AND PORTABLE TERMINAL HAVING THE SAME

CROSS-REFERENCE TO RELATED APPLICATION(S) AND CLAIM OF PRIORITY

The present application is related to and claims priority under 35 U.S.C. §119(a) to a Korean Patent Application No. 10-2012-0074930, entitled "Broadband Variable Antenna Device for Portable Terminal", filed on Jul. 10, 2012, in the Korean Industrial Property Office, the entire disclosure of which is incorporated herein by reference.

TECHNICAL FIELD OF THE INVENTION

The present disclosure relates to a portable terminal, and more particularly to an antenna device and a portable terminal equipped with the antenna device.

BACKGROUND OF THE INVENTION

In general, a portable terminal refers to a device carried by a user to perform communication with another user (e.g. voice communication, short message transmission), data communication (e.g. Internet, mobile banking, multimedia file transmission), and entertainment (e.g. games, music and moving image playback). Portable terminals have generally been specified for respective functions (e.g. communication, gaming, multimedia, electronic organizer), but recent development of electric/electronic and communication technologies has made it possible to enjoy various functions with a single mobile communication terminal.

Widespread use of mobile communication terminals is followed by persistent efforts to equip terminals not only with communication functions provided by communication service providers, but also with wireless LAN or NFC (Near Field Communication) functions so that a mobile communication terminal alone is enough to control a vehicle or domestic appliance, settle transportation fees, or realize a security function. As a result, portable terminals, typical examples of which are mobile communication terminals, need to be equipped with various antenna devices. That is, mobile communication services, wireless LANs, and NFC occur in different frequency bands, requiring respective antenna devices.

Furthermore, recent transition to the fourth-generation communication scheme, typical examples of which include WiBro and LTE (Long Term Evolution), requires super-fast broadband antenna devices. As such, in line with development of communication technologies, portable terminals require high-performance antenna devices.

SUMMARY OF THE INVENTION

To address the above-discussed deficiencies of the prior art, it is a primary object to provide an antenna device adapted to make a portable terminal compact and slim.

Further, the present disclosure provides an antenna device adapted to utilize the inner space of a portable terminal efficiently while making the portable terminal compact and slim.

Further, the present disclosure provides an antenna device for a portable terminal, which has multiband characteristics and which is capable of securing broadband characteristics in different resonance frequency bands.

In accordance with an aspect of the present disclosure, there is provided an antenna device for a portable terminal, including a circuit board having a conductive layer formed on a surface; a first slit formed by partially removing the conductive layer in a position adjacent to one side of the circuit board, the first slit extending in parallel with a lateral periphery of the circuit board; a radiation portion including a part of the conductive layer positioned on the lateral periphery of the circuit board in one side of the first slit; and a feed line placed on the first slit and adapted to feed the radiation portion from the other side of the first slit, wherein the radiation portion includes a second slit extending, from the first slit to the lateral periphery of the circuit board across part of the conductive layer forming the radiation portion; and a frequency adjustment element placed on the second slit and adapted to connect in series the conductive layers divided by the second slit and positioned in both sides of the second slit.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION OF THE INVENTION

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged wireless communication device. Hereinafter, the exemplary embodiments of the present invention will be described with reference to the accompanying drawings in detail. Further, various specific definitions found in the following description are provided only to help general understanding of the present invention, and it will be understood by those skilled in the art that various changes and modifications can be made thereto within the technical spirit and scope of the present invention. In the following description, a detailed explanation of known related functions and constitutions may be omitted to avoid unnecessarily obscuring the subject matter of the present invention.

Figure 1:
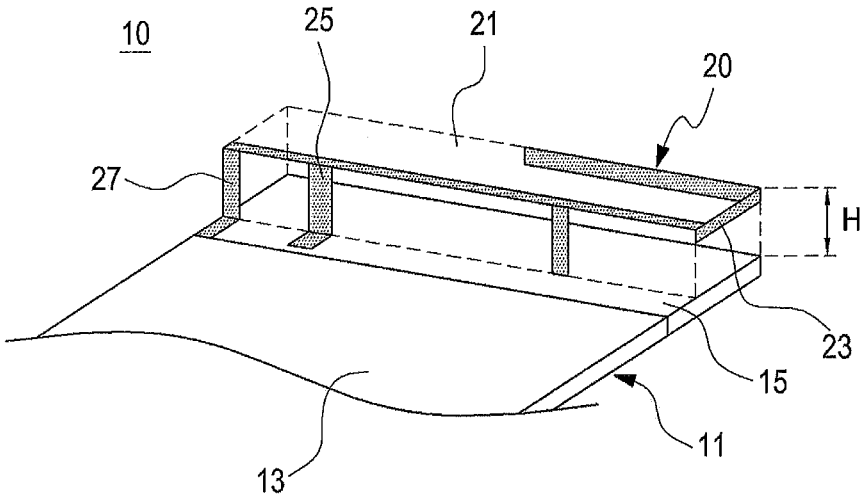
FIG. 1 is a perspective view schematically illustrating an inverted F antenna (IFA) antenna device for a portable terminal.

FIG. 1 is a perspective view schematically illustrating a antenna device 10 for a portable terminal, which is based on an Inverted F Antenna (IFA) structure.

The antenna device 10 includes a carrier 21 mounted on a circuit board 11, and a radiation portion pattern 23 formed on the carrier 21. The radiation portion pattern 23 is designed to fit the frequency band and radiation performance required for the portable terminal. A short-circuit pin 27 is provided on an end of the radiation portion pattern 23 and connected to a ground layer 13. A feed line 25 is formed at a predetermined distance from the short-circuit pin 27.

When the radiation portion pattern 23 is positioned on the ground layer 13 in the case of such an IFA structure, applying a transmission/reception signal to the radiation portion pattern 23 generates an induced current in the ground layer 13 in a direction opposite to signal power flowing through the radiation portion pattern 23. The intensity of the inverse current in the ground layer 13 is proportional to the signal power applied to the radiation portion pattern 23 and is inversely proportional to the distance between the ground layer 13 and the radiation portion pattern 23. The occurrence of inverse current degrades the antenna performance, particularly radiation efficiency, and, in order to suppress it, it is preferred to arrange the ground layer 13 and the radiation portion pattern 23 far from each other.

However, when an antenna device 10 is mounted on a portable terminal, a large distance between the ground layer 13 and the radiation portion pattern 23, i.e. height H of the carrier 21 on the circuit board 11, is an obstacle to making the portable terminal compact.

As an alternative approach to reduce the height of the carrier in an IFA structure, the ground layer 13 on the circuit board 11 can be removed partially to form a fill cut area 15, in which the carrier 21 is positioned. In such a structure, the radiation portion pattern 23 is arranged on the circuit board 11 away from the ground layer 13. Placement of the radiation portion pattern 23 in the fill cut area 15 prevents occurrence of the inverse current, so that the radiation portion pattern 23 can be positioned closer to the circuit board 11. In other words, formation of the fill cut area 15 reduces the thickness of the antenna device 10. However, the fact that no other components can be mounted in the fill cut area 15 on the circuit board 11 degrades the utilization efficiency compared with the area of the circuit board 11.

Consequently, the IFA structure can implement super-fast broadband performance and is useful for mounting on a portable terminal, but still poses an obstacle to making the portable terminal compact and slim.

Meanwhile, a variable antenna structure can be employed to secure broadband, multiband characteristics not only of the above-mentioned IFA or planar IFA, but also of a roof antenna which is used as an embedded antenna, or a monopole-type antenna. In the case of an IFA or a planar IFA, for example, an impedance matching adjustment element can be placed on the feed line 25, a switching element can be placed to enable selection of a short-circuit path of a short-circuit pin 27, or a shunt capacitor element can be used to adjust the resonance frequency of the radiation portion pattern 23.

However, use of an impedance matching adjustment element or a switching element has a problem in that, although multiband characteristics can be secured relatively easily, broadband characteristics degrade in the resonance frequency band. In addition, use of a shunt capacitor has a problem in that, although broadband characteristics can be secured relatively easily in the resonance frequency band, the radiation efficiency degrades abruptly in low frequency bands.

As illustrated in FIGS. 2-7, an antenna device 100 for a portable terminal according to a preferred embodiment of the present disclosure includes a circuit board 101 having a conductive layer 111 formed thereon, a first slit 113 formed by partially removing the conductive layer 111, a radiation portion including a part of the conductive layer 111, which is positioned in a lateral periphery of the circuit board 101 on one side of the first slit 113, and a feed line 115 placed in the first slit 113 to feed the radiation portion from the other side of the first slit 113. The radiation portion includes a second slit 213 extending across a part of the conductive layer 111, and a frequency adjustment element **113*e* placed on the second slit 213 to connect in series the separate conductive layers on both sides of the second slit 213**.

On the circuit board 101, a communication circuit for transmitting/receiving signals through the antenna device 100, as well as various memories and control circuits for controlling the operation of the portable terminal or storing information, are mounted. The conductive layer 111 is provided on a surface of the circuit board 101 to provide a ground of circuit. As such, the circuit board 101 can be used as a main circuit board of the portable terminal.

As mentioned above, the first slit 113 is formed by removing a part of the conductive layer 111, and extends on the circuit board 101 in one direction. Preferably, one end of the first slit 113 is open to a periphery of the conductive layer 111, and the other end is positioned within the conductive layer 111 and closed. The first slit 113 extends in parallel with a lateral periphery of the circuit board 101 in a position close to the lateral periphery of the circuit board 101.

The radiation portion includes a part of the conductive layer 111 and bypasses the other end of the first slit 113 to be connected to the remaining part of the conductive layer 111. The part, which is positioned in parallel with the other end of the first slit 113 and is connected to the remaining part of the conductive layer 111, is used as a short-circuit pin

113*d* of the radiation portion. The second slit 213 provided on the radiation portion extends from the first slit 113 to a lateral periphery of the circuit board 101 and bisects a part of the conductive layer 111 in one side of the first slit 113. More particularly, the second slit 213 is, as in the case of the first slit 113, formed by removing a part of the conductive layer that forms the radiation portion. The frequency adjustment element 113*e* placed on the second slit 213 connects in series separate portions 113*b* and 113*c* of the conductive layer 111 in both sides of the second slit 213, which divides them. Among the portions 113*b* and 113*c* of the conductive layer 111, which are divided by the second slit 213, the portion connected to the remaining part of the conductive layer 111 through the short-circuit pin 113*d* will hereinafter be referred to as a first radiation portion 113*b*, and the portion connected in series to the first radiation portion 113*b* through the frequency adjustment element 113*e* will be referred to as a second radiation portion 113*c*.

The feed line 115 extends across the first slit 113 from the other side 113*a* of the first slit 113 and connects to the radiation portion, specifically the first radiation portion 113*b*, on one side of the first slit 113. A variable-capacity IC chip 119, such as an impedance matching element or a variable capacitor, can be placed on the feed line 115 or around the feed line 115 for the purpose of impedance matching, resonance frequency adjustment, precise adjustment of overall operation characteristics of the antenna device 100 and the like. Of course, the impedance matching etc. can be accomplished by adjusting the position of the feed line 115, e.g. the distance d between the other end of the first slit 113 and the feed line 115. During modification of the resonance frequency of a multiband antenna, however, a variable-capacity IC chip 119 can be used for precise adjustment of operation characteristics of the antenna device.

The frequency adjustment element 113*e* is adapted to adjust the resonance frequency of the antenna device 100 in response to a control signal applied through a communication circuit mounted on the circuit board 101. As the frequency adjustment element 113*e*, a combination of a SPDT (Single Pole Double Throw) antenna switch and a lumped element or a variable capacitor, for example, can be used. In order to deliver power necessary for operation of the frequency adjustment element 113*e*, control signals, data signals, etc., the circuit board 101 has a separate signal line 113*f* (shown in FIG. 6).

Figure 5:
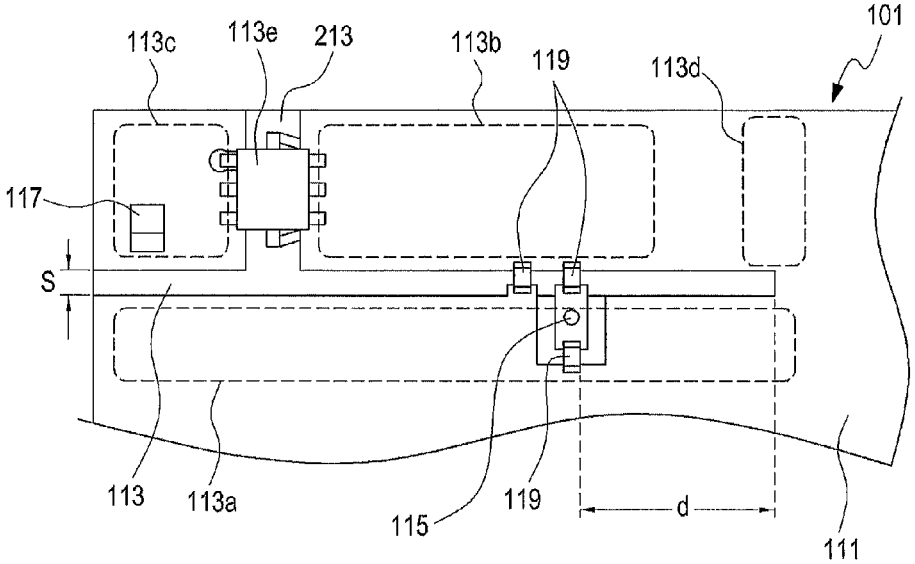
FIG. 5 is a top view illustrating a circuit board of the antenna device illustrated in FIG. 3.
Figure 6:
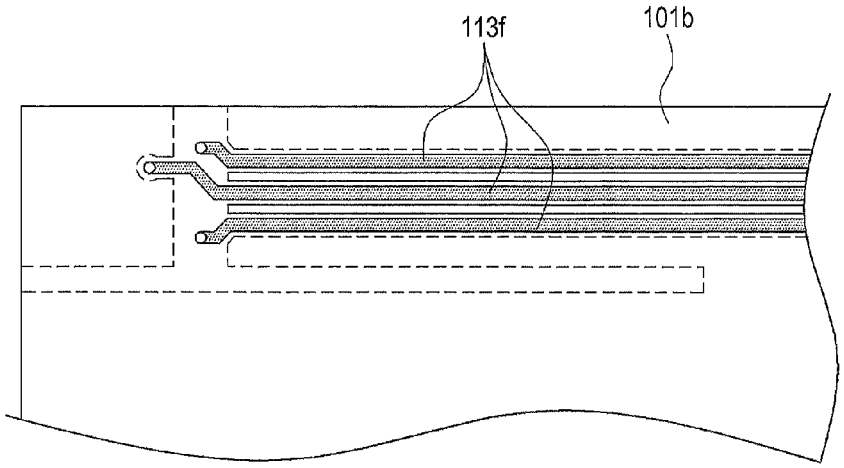
FIG. 6 is a lateral view illustrating a second layer of the circuit board illustrated in FIG. 5.
Figure 7:
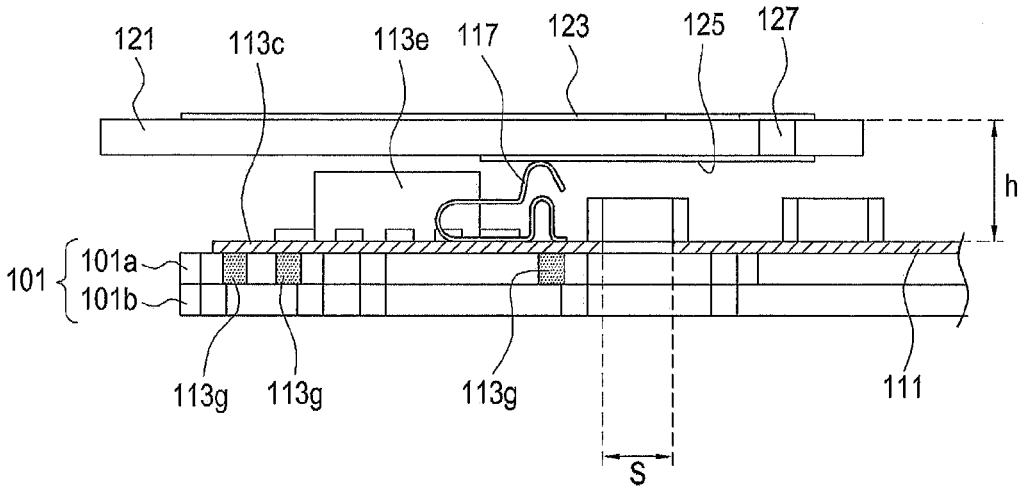
FIG. 7 illustrates a sectional structure of the antenna device illustrated in FIG. 2.
Figure 8:
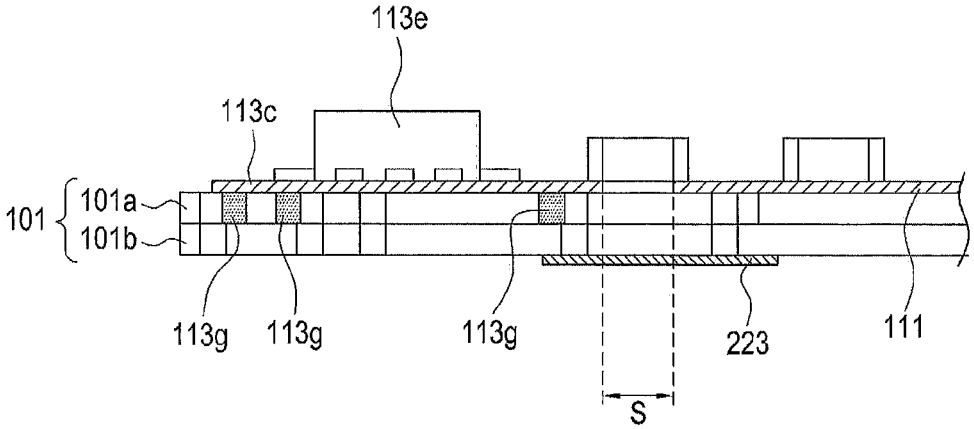
FIG. 8 illustrates a sectional structure of an alternative to the antenna device illustrated in FIG. 2.

With reference to FIGS. 5-7, the circuit board 101 includes a plurality of layers. Those skilled in the art can understand that, although it is assumed for clarity of description that the circuit board 101 includes only first and second layers 101*a* and 101*b* according to one embodiment of the present disclosure, the number of layers constituting the circuit board 101 can vary.

On a surface of the first layer 101*a*, substantially on a surface of the circuit board 101, the conductive layer 111, the first slit 113, the radiation portion and the frequency adjustment element 113*e* are arranged, as shown in FIG. 5. The second layer 101*b* is bonded to face the other surface of the first layer 101*a* while being insulated from the first layer 101*a*. On a surface of the second layer 101*b*, specifically on its surface facing the first layer 101*a*, at least one pair of the signal lines 113*f* are formed to deliver power, control signals and data signals provided to the frequency adjustment element 113*e*. The power, control signals, and data signals delivered through the signal lines 113*f* are delivered to the frequency adjustment element 113*e* through at least one of via-holes 113*g* formed through the first layer 101*a*.

Meanwhile, the radiation portion is used as a radiator of the antenna device 100 with regard to high-frequency waves, but provides an electric ground in terms of low-frequency waves. In other words, the radiation portion is both used as a radiator of the antenna device 100 and capable of providing the frequency adjustment element 113*e* with a ground. Therefore, the ground pin of the frequency adjustment element 113*e* is connected and grounded to the radiation portion, specifically the first radiation portion 113*b*.

Such arrangement of a frequency adjustment element in series within the radiation portion using a variable capacitor, for example, guarantees that the resonance frequency of the antenna device 100 can be secured variously. Operation characteristics of the antenna device 100 when a variable capacitor is installed as the frequency adjustment element 113*e* will be described later in more detail with reference to FIGS. 9-11.

An additional radiator or variable-capacity IC chip, for example, can be used according to the specifications of a portable terminal, to which the antenna device 100 is to be applied.

Figure 2:
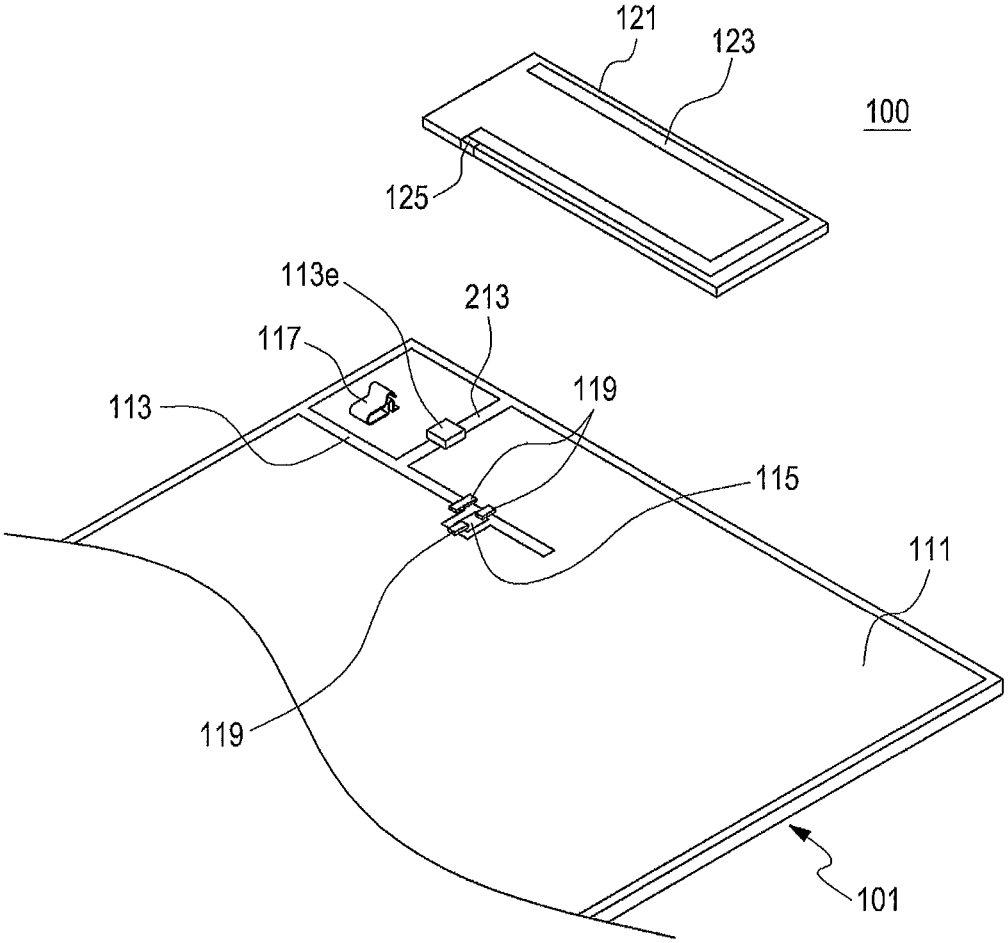
FIG. 2 is a perspective view illustrating an antenna device for a portable terminal according to a preferred embodiment of the present disclosure.

The antenna device 100 illustrated in FIG. 2 has an exemplary structure for providing an additional radiator by forming a radiation portion pattern 123 on an auxiliary board 121. In order to connect the radiation portion pattern 123 to the radiation portion, specifically the second radiation portion 113*c*, a connection terminal 117 is installed on the circuit board. The connection terminal 117 is exemplified by a C-clip, which is obtained by processing a leaf spring. The C-clip is fixed and electrically connected to the second radiation portion 113*c*.

Figure 3:
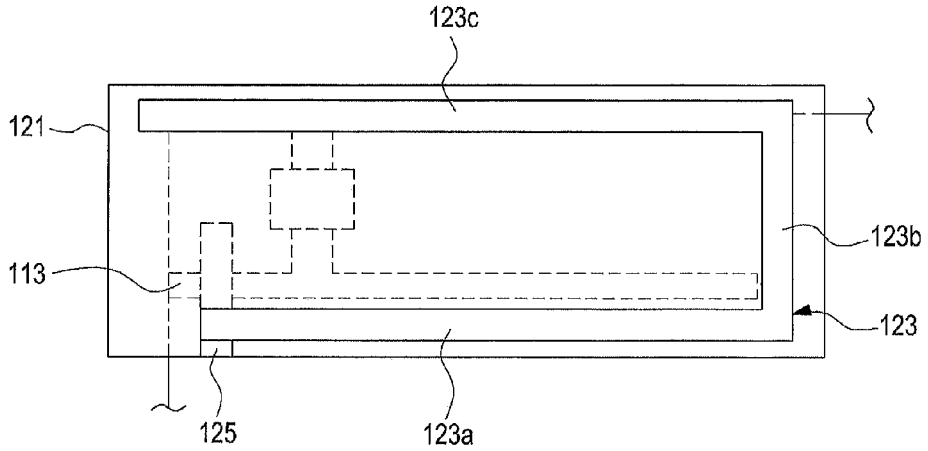
FIG. 3 is a top view of the antenna device illustrated in FIG. 2.
Figure 4:
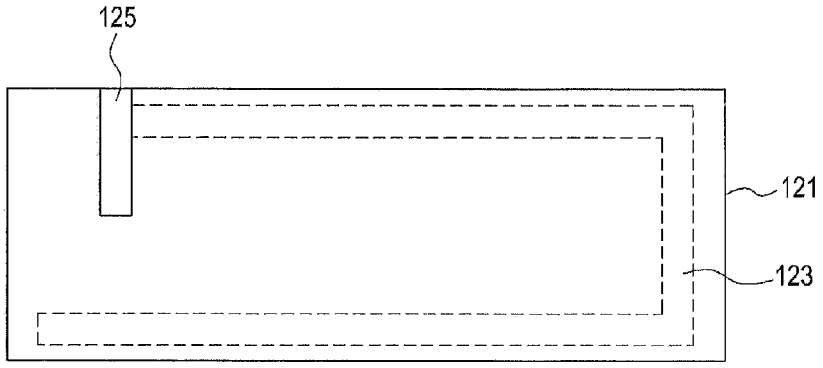
FIG. 4 is a top view illustrating the bottom surface of an auxiliary board of the antenna device illustrated in FIG. 2.

With reference further to FIGS. 3, 4 and 7, the auxiliary board 121 is placed over the first slit 113 while facing a surface of the circuit board 101. From the top view of FIG. 3, the first slit 113 is hidden by the auxiliary board 121. The auxiliary board 121 can be made of a synthetic resin or a dielectric substance used to fabricate a conventional circuit board.

The radiation portion pattern 123 can be formed by processing a printed-circuit pattern or a thin metal plate and attaching it on a surface of the auxiliary board 121. A radiation portion pattern using a printed-circuit pattern is directly formed on the auxiliary board 121 through a plating/etching process, for example, or is formed by attaching a flexible printed-circuit board to the auxiliary board 121. A radiation portion pattern using a thin metal plate is formed by cutting out a thin plate of a metal material (e.g. copper) according to the required pattern and attaching it to the auxiliary board 121. The radiation portion pattern 123 preferably extends so as to surround partially at least each of one side, the other end, and the other side of the first slit 113.

With reference to FIG. 3, the radiation portion pattern 123 includes a first extension portion 123*a*, a second extension portion 123*b*, and a third extension portion 123*c*. The first extension portion 123*a* is positioned on the conductive layer 111 on the other side of the first slit 113, and extends in parallel with the first slit 113. The second extension portion 123*b* extends from one end of the first extension portion 123*a* so as to surround the other end of the first slit 113, i.e. the closed end of the first slit 113. A part of the second extension portion 123*b* can overlap the other end of the first slit 113. The third extension portion 123*c* extends from an end of the second extension portion 123*b* in parallel with the first slit 113, and is positioned on the radiation portion in one side of the first slit 113.

That is, parts of the radiation portion pattern 123 extend on both sides of the first slit 113 in parallel, respectively, and are connected to the other end of the first slit 113 each other. The radiation portion pattern 123 can further include an additional extension portion extending from an end of the third extension portion 123*c* as a free pattern. The pattern of the additional extension portion is determined to optimize the frequency band in which the antenna device 100 operates, the radiation efficiency and the like.

It is to be noted that, in connection with explanation of the radiation portion pattern 123, the expression "formed or arranged so as to surround the first slit" does not actually mean that the radiation portion pattern 123 is positioned around the first slit 113 at the same height as the first slit 113. More particularly, the first slit 113 is formed on the conductive layer 111, and the radiation portion pattern 123 is formed on the auxiliary board 121, which is arranged to face the conductive layer 111, meaning that the radiation portion pattern 123 and the first slit 113 are positioned at different heights with regard to the circuit board 101. However, the radiation portion pattern 123 appears to be positioned around the first slit 113 upon a top view of the antenna device 100 (e.g. FIG. 3), which is expressed as "formed or arranged so as to surround the slit".

In the case of the antenna device 100 having the above-mentioned structure, an induced current is generated in the conductive layer 111, including the radiation portion, by signal power flowing through the radiation portion pattern 123. However, a current flow can be induced in the conductive layer 111 depending on the structure for applying a signal to the radiation portion pattern 123. That is, generation of a current flow through the conductive layer 111 in the same direction as that of signal power flowing through the radiation portion pattern 123 suppresses occurrence of inverse current. This is made possible by using the other side of the first slit 113, i.e. a partial area of the conductive layer 111, in which the third extension portion 123*c* is positioned, as the radiation portion pattern 123. Although the pattern formed on the auxiliary board 121 is referred to as a radiation portion pattern 123 according to one embodiment of the present disclosure, for clarity of description, the antenna device 100 uses a part of the conductive layer 111, i.e. the radiation portion, as a radiator.

The connection terminal 117, which has been mentioned above, contacts a connection pattern 125 formed on the other surface of the auxiliary board 121 to be electrically connected to the radiation portion pattern 123. As illustrated in FIGS. 3 and 4, the connection pattern 125 extends from the other surface of the auxiliary board 121 so as to surround a lateral surface of the auxiliary board 121 so that it is connected from the other surface of the auxiliary board 121 to the radiation portion pattern 123. Alternatively, the connection pattern 125 is formed only on the other surface of the auxiliary board 121 and, as illustrated in FIG. 7, electrically connected to the radiation portion pattern 123 through a via-hole 127 formed through the auxiliary board 121.

The antenna device 100 receives a transmission signal through the feed line 115. The transmission signal applied to the feed line 115 passes through the first radiation portion 113*b*, the frequency adjustment element 113*e* and the second radiation portion 113*d* successively and proceeds to the radiation portion pattern 123 through the connection terminal 117. Consequently, the first and second radiation portions 113*b* and 113*c* on one side of the first slit 113 are, together with the radiation portion pattern 123, used as a radiator of the antenna device 100.

Concurrent with applying a transmission signal to the feed line 115, a current flow is formed around the first slit 113. Such a current flow follows a counterclockwise direction around the first slit 113 illustrated in FIG. 5. Signal power, which flows through the radiation portion pattern 123 in response to the transmission signal applied to the feed line 115, also follows the counterclockwise direction around the first slit 113, meaning that the current flow around the first slit 113 and the flow of signal power through the radiation portion pattern 123 follow the same direction. This prevents an inverse current from being induced around the first slit 113 during signal transmission/reception operations.

Such prevention of occurrence of an inverse current in the conductive layer 111 using signal power applied to the radiation portion pattern 123 guarantees that the radiation portion pattern 123 can be arranged adjacent to the conductive layer 111 that provides a ground. Therefore, the antenna device according to the present disclosure can both secure stable antenna performance and easily reduce the size, specifically the thickness, of the antenna device. That is, compared with a IFA, for example, the distance H between the conductive layer 111, which provides a ground, and the radiation portion pattern 123 can be reduced. In the case of a conventional embedded antenna applied to a portable terminal, an interval of at least 5 mm needs to be maintained between the ground layer 11 and the radiation portion pattern 23, in order to secure stable antenna performance. In contrast, the antenna device 100 according to the present disclosure can secure performance comparable to or superior to that of a conventional antenna device even if the radiation portion pattern 123 is formed at a distance of 2 mm or less from the conductive layer 111.

Furthermore, when an embedded antenna (e.g. IFA) is placed, the ground layer needs to be removed partially to form a fill cut area in order to secure antenna performance. However, a partial area of the conductive layer 111 used as a radiator, i.e. the first and second radiation portions 113*b* and 113*c*, can still provide a ground. In other words, in high-frequency ranges in which the antenna device 100 operates, the first and second radiation portions 113*b* and 113*c* act as a part of the radiator, but can still provide a ground with regard to some electric components or fastening members for assembly, which operate in low-frequency ranges. Therefore, compared with a conventional embedded antenna, the antenna device 100 according to the present disclosure can both easily reduce the thickness and increase the efficiency of utilization of the circuit board 101.

Meanwhile, instead of the auxiliary board 121 and the radiation portion pattern 123, the antenna device 100 according to one embodiment of the present disclosure can have, as an additional radiator, a different radiation portion pattern 223 (illustrated in FIG. 8) formed on the other surface of the circuit board 101. The radiation portion pattern 223 can be obtained by attaching a printed-circuit pattern or a thin metal plate to the other surface of the circuit board 101. The radiation portion pattern 223 is electrically connected to the second radiation portion 113*c* through a via-hole 113*h* formed through the circuit board 101. The radiation portion 223 is supposed to prevent occurrence of an inverse current as in the case of the radiation portion pattern 123 formed on the auxiliary board 121. That is, the radiation portion pattern 223 can be formed on the other surface of the circuit board 101 to have the same shape as the radiation portion pattern 123 illustrated in FIG. 3.

Such arrangement of an additional radiator on the other surface of the circuit board 101 is more beneficial to reduction of the thickness of the antenna device because no separate auxiliary board or connection terminal is necessary.

The operation frequency of the above-mentioned antenna device 100 can be adjusted according to the width of the first slit 113, the width or shape of the radiation portion pattern 123, and the like. It is also possible to adjust the operation frequency or the frequency bandwidth by arranging a lumped circuit element, for example, on the radiation portion pattern 123 or the first slit 113. Furthermore, additional slits can be formed on the first and second radiation portions 113*b* and 113*c*, or operation characteristics of the antenna device 100 can be adjusted according to the shape of the radiation patterns 123 and 223.

Figure 9:
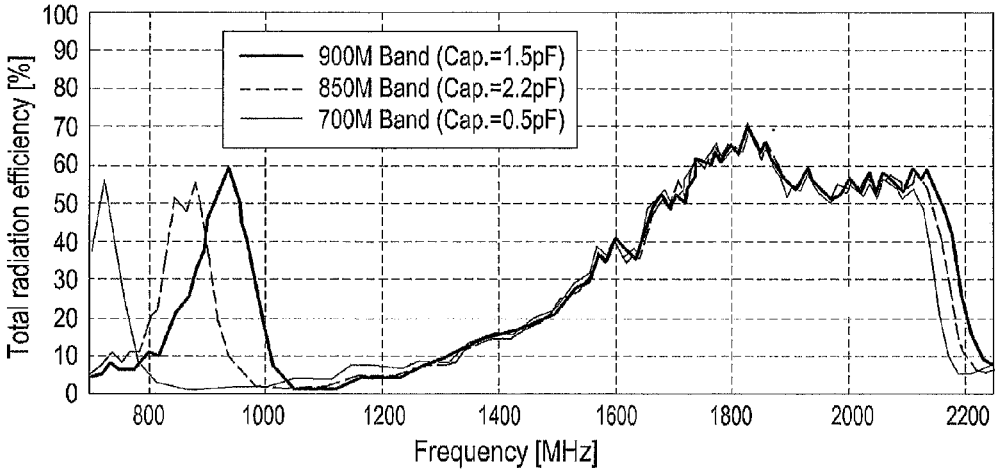
FIG. 9 illustrates a result of measurement of the overall radiation efficiency of the antenna device illustrated in FIG. 2.
Figure 10:
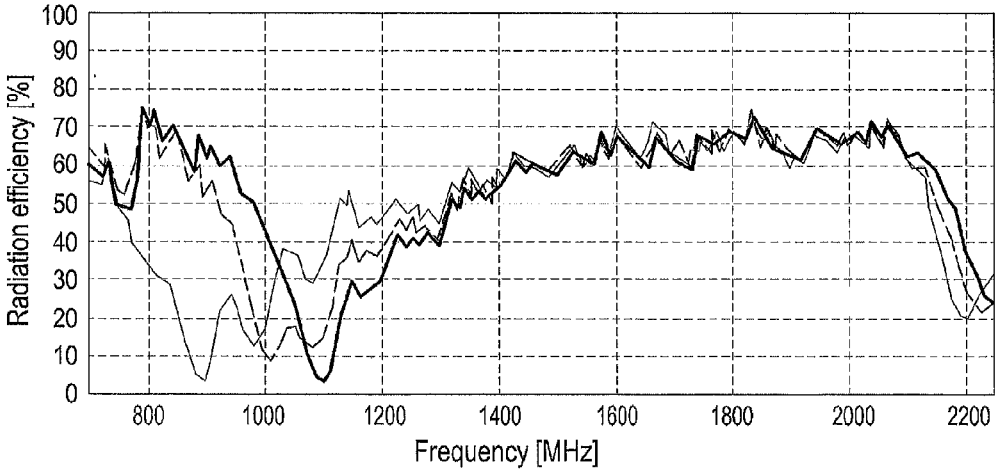
FIG. 10 illustrates a result of measurement of radiation efficiency of the antenna device illustrated in FIG. 2.
Figure 11:
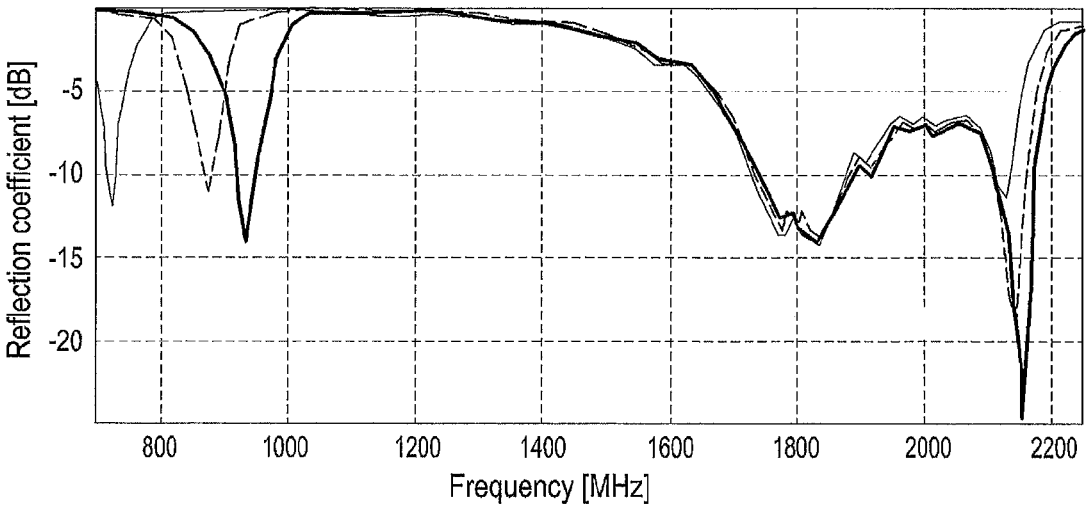
FIG. 11 illustrates a result of measurement of a reflection coefficient of the antenna device illustrated in FIG. 2.

Results of measurement of operation characteristics, i.e. overall radiation efficiency, radiation efficiency and reflection coefficient, of the antenna device obtained by using a variable capacitor as the frequency adjustment element 113*e* are illustrated in FIGS. 9-11. It is clear that, when the electrostatic capacity of the variable capacitor is set as 1.5 pF, 2.2 pF and 5.0 pF, respectively, resonance frequencies are secured in the bands of 900 MHz, 850 Mhz, and 700 Mhz and regardless of the electrostatic capacity of the variable capacitor, resonance frequencies can be secured in bands of about 1.8 GHz, 2.1 GHz and the like. As such, it is clear from FIGS. 9-11 that the antenna device according to the present disclosure can secure resonance frequencies in different frequency bands by controlling the frequency adjustment element.

The antenna device for a portable terminal, which has the above-mentioned construction, has the following advantages: a conductive layer is formed on a surface of the circuit board, a slit is formed to use a part of the conductive layer as a radiation portion, and a frequency adjustment element is arranged in series on the radiation portion, making it easy to secure multiband characteristics. A part of the conductive layer on the circuit board is used as a radiation portion, and a part of the remainder is used as a ground portion. The ground portion and the radiation portion are arranged on the same layer, rendering the antenna device compact. An additional radiation portion pattern formed on the conductive layer prevents occurrence of an inverse current around the slit and thus prevents degradation of radiation performance. Therefore, even if the additional radiation portion pattern is formed on the circuit board, increase of thickness of the portable terminal is minimized.

Although the present disclosure has been described with exemplary embodiments, various changes and modifications may be suggested to one skilled in the art. It is intended that the present disclosure encompass such changes and modifications as fall within the scope of the appended claims.

What is claimed is:

1. An antenna device for a portable terminal, comprising:

a circuit board having a conductive layer formed on a surface;

a first slit formed by partially removing the conductive layer in a position adjacent to one side of the circuit board, the first slit extending in parallel with a lateral periphery of the circuit board;

a radiation portion comprising a part of the conductive layer positioned on the lateral periphery of the circuit board in one side of the first slit; and a feed line that is placed in the first slit and is configured to couple the radiation portion from another side of the first slit;

a second slit extending from the first slit to the lateral periphery of the circuit board across a part of the conductive layer forming the radiation portion;

a frequency adjustment element that is placed on the second slit and is configured to connect in series portions of the conductive layer divided by the second slit and positioned in both sides of the second slit; and an auxiliary board that has a radiation pattern thereon, and is mounted over the circuit board, wherein the radiation pattern is electronically connected to a portion of the conductive layer, and is extended to partially surround the first slit when seen in a top view, wherein when a transmission signal applied to the feed line, the antenna device generates a current flow around the first slit in a direction following a signal power, which flows through the radiation pattern such that the antenna device prevents an inverse current with respect to the signal power from being induced around the first slit.

2. The antenna device as claimed in claim 1, wherein the radiation portion comprises a first radiation portion bypassing the first slit and connected to the conductive layer in the other side of the first slit, and a second radiation portion separated from the first radiation portion by the second slit, wherein the feed line is connected to the first radiation portion.

3. The antenna device as claimed in claim 1, wherein the circuit board comprises a first layer having the conductive layer formed on a surface, a second layer facing an opposite surface of the first layer while being insulated from the first layer, and signal lines formed on a top surface of the second layer, wherein the frequency adjustment element is provided with power and control signals through the signal lines.

4. The antenna device as claimed in claim 3, wherein the circuit board further comprises a plurality of via-holes formed through the first layer, and each signal line is connected to the frequency adjustment element through one of the via-holes respectively.

5. The antenna device as claimed in claim 1, wherein the frequency adjustment element is either a combination of a SPDT (Single Pole Double Throw) antenna switch and a lumped element, or a variable capacitor.

6. The antenna device as claimed in claim 1, wherein the frequency adjustment element has a ground pin connected and grounded to the radiation portion.

7. The antenna device as claimed in claim 1, wherein the auxiliary board is positioned on the first slit and placed to face a top surface of the circuit board, and the radiation pattern is formed on one surface of the auxiliary board and is arranged so as to partially surround the first slit.

8. The antenna device as claimed in claim 7, wherein the radiation pattern has a part extending on both sides of the first slit in parallel with the first slit, the part surrounding a closed end of the first slit.

9. The antenna device as claimed in claim 7, further comprising:

a connection terminal installed on the conductive layer on the other side of the first slit; and a connection pattern provided on a first surface of the auxiliary board, the connection terminal being in contact with the connection pattern.

10. The antenna device as claimed in claim 9, wherein the radiation pattern is provided on a second surface of the auxiliary board, and the connection pattern extends so as to surround a lateral surface of the auxiliary board and connect to the radiation pattern on the second surface of the auxiliary board.

11. The antenna device as claimed in claim 9, wherein a via-hole is formed through the auxiliary board, and the connection pattern is electrically connected to the radiation pattern through the via-hole.

12. The antenna device as claimed in claim 1, further comprising impedance matching elements provided on the feed line.

13. The antenna device as claimed in claim 2, further comprising:

a second radiation pattern formed on a different surface of the circuit board; and a second via-hole formed through the circuit board, the second radiation pattern being connected to the radiation portion through the second via-hole.

14. The antenna device as claimed in claim 1, further comprising a variable-capacity IC chip connecting the conductive layer on the other side of the first slit and the radiation portion.

15. The antenna device as claimed in claim 14, wherein the variable-capacity IC chip is placed on the feed line.

16. A wireless communication device comprising an antenna unit, the antenna unit comprising:

a circuit board having a conductive layer attached on a surface;

a first slit formed by partially removing the conductive layer in a position adjacent to one side of the circuit board, the first slit extending in parallel with a lateral periphery of the circuit board;

a radiation portion comprising a part of the conductive layer positioned on the lateral periphery of the circuit board in one side of the first slit; and a feed line that is placed in the first slit and is configured to couple the radiation portion from another side of the first slit, a second slit extending from the first slit to the lateral periphery of the circuit board across a part of the conductive layer forming the radiation portion;

a frequency adjustment element that is placed in the second slit and is configured to connect in series the conductive layers divided by the second slit and positioned in both sides of the second slit; and an auxiliary board that has a radiation pattern thereon, and is mounted over the circuit board, wherein the radiation pattern is electronically connected to a portion of the conductive layer, and is extended to partially surround the first slit when seen in a top view, wherein when a transmission signal applied to the feed line, the antenna unit generates a current flow around the first slit in a direction following a signal power, which flows through the radiation pattern such that the antenna unit prevents an inverse current with respect to the signal power from being induced around the first slit.

17. The wireless communication device as claimed in claim 16, wherein the radiation portion comprises a first radiation portion bypassing the first slit and connected to the conductive layer in the other side of the first slit, and a second radiation portion separated from the first radiation portion by the second slit, wherein the feed line is connected to the first radiation portion.

18. The wireless communication device as claimed in claim 16, wherein the circuit board comprises a first layer made of conductive layer formed on a surface, a second layer facing an opposite surface of the first layer while being insulated from the first layer, and signal lines formed on a top surface of the second layer, and the frequency adjustment element is provided with power and control signals through the signal lines.

19. The wireless communication device as claimed in claim 18, wherein the circuit board further comprises a plurality of via-holes formed through the first layer, and each signal line is connected to the frequency adjustment element through one of the via-holes respectively.

20. The wireless communication device as claimed in claim 16, wherein the frequency adjustment element is either a combination of a SPDT (Single Pole Double Throw) antenna switch and a lumped element, or a variable capacitor.

* * * * *